United States Patent [19]

Leyland

[11] 4,361,525

[45] * Nov. 30, 1982

[54] AIR COOLING APPARATUS

[76] Inventor: Billy M. Leyland, 7537 N. 16th La., Phoenix, Ariz. 85021

[ * ] Notice: The portion of the term of this patent subsequent to Jan. 26, 1999, has been disclaimed.

[21] Appl. No.: 317,118

[22] Filed: Nov. 2, 1981

Related U.S. Application Data

[63] Continuation-in-part of Ser. No. 207,955, Nov. 18, 1980, Pat. No. 4,312,819.

[51] Int. Cl.[3] ..... B01F 3/04

[52] U.S. Cl. ..... 261/152; 62/310; 62/314; 62/315; 62/DIG. 16; 98/30; 165/60; 261/29; 261/36 R; 261/108; 261/151; 261/DIG. 3

[58] Field of Search ..... 261/29, 36 R, 108, 151, 261/152, 158–161, DIG. 3, DIG. 4, DIG. 41, DIG. 77; 165/47, 60; 62/305, 310, 314, 315, DIG. 16; 98/2.11, 2.14, 30

[56] References Cited

U.S. PATENT DOCUMENTS

| | | | |
|---|---|---|---|
| 1,985,910 | 1/1935 | Anderson | 165/60 |
| 2,576,549 | 11/1951 | Wagner et al. | 62/DIG. 16 |
| 2,725,729 | 12/1955 | Mills | 62/314 X |
| 3,116,612 | 1/1964 | Pennington | 62/310 X |
| 3,153,332 | 10/1964 | Goettl et al. | 62/310 X |
| 3,802,493 | 4/1974 | Goettl | 165/60 |
| 4,107,942 | 8/1978 | Fairman | 62/305 |
| 4,204,409 | 5/1980 | Satama | 62/305 X |
| 4,284,128 | 8/1981 | Nelson | 261/DIG. 3 |
| 4,312,819 | 1/1982 | Leyland | 261/152 |

*Primary Examiner*—Richard L. Chiesa
*Attorney, Agent, or Firm*—Herbert E. Haynes, Jr.

[57] ABSTRACT

An apparatus for efficiently and economically cooling air by sequentially passing the air to be cooled through a chilled water heat exchanger mechanism and then through an evaporative cooler mechanism.

8 Claims, 3 Drawing Figures

AIR COOLING APPARATUS

CROSS-REFERENCE TO RELATED APPLICATION

This application is a continuation-in-part of a copending application, Ser. No. 207,955, filed Nov. 18, 1980, for Air Cooling Apparatus by the same inventor which issued as U.S. Pat. No. 4,312,819, on Jan. 26, 1982.

BACKGROUND OF THE INVENTION

1. Field of the Invention

This invention relates in general to air conditioning devices and more particularly to an air cooling apparatus which operates on the principles of evaporative cooling and heat exchange.

2. Description of the Prior Art

Devices for cooling air by the evaporation principle have been used for many years with the most successful use of such devices occurring in relatively dry climates for both commercial and residential applications.

The most common evaporative cooler in use today includes a cabinet in which an air moving device, usually in the form of a motor driven centrifugal blower, is mounted for drawing relatively hot and dry ambient air into the cabinet through wettable pads mounted in the sides thereof. As the incoming ambient air moves through the wet pads, it is cooled by evaporation and the air moving device delivers the cooled air to an outlet that is normally mounted in the bottom of the cabinet. A sump located in the bottom of the cooler cabinet is provided with a float controlled shutoff valve which maintains a predetermined water level in the sump, and a motor driven pump is employed to supply water under pressure from the sump into a distribution plumbing network mounted in the top of the cabinet. The water is delivered to the tops of the pads by the plumbing network and flows under the influence of gravity through the pads with the unevaporated water returning to the sump for recirculation.

Although evaporative coolers of the above described type have long been recognized as low cost and relatively efficient mechanisms, their effective use is inherently limited to times when the humidity is low in that their air cooling capability diminishes as the humidity in the atmosphere increases.

Due to the lessening of air cooling effectiveness in times of relatively high humidity, many existing evaporative coolers were replaced with refrigeration units when such units were developed in suitable packages and became available at reasonable initial investment costs, and new construction went almost exclusively to the use of refrigeration units. This trend away from evaporative coolers to refrigeration units in comparatively dry regions started about 20 to 25 years ago and was very well accepted by the consuming public as long as energy was plentiful and relatively inexpensive.

Now, however, with energy in relatively short supply and becoming more expensive every day, many are looking once again to the evaporative cooler as a source of energy conservation and economic relief. The trend today is not a complete reversal of the movement away from evaporative coolers, but is toward a compatable union of evaporative coolers and refrigeration units.

To establish a compatable union, many consumers are placing both an evaporative cooler and a refrigeration unit in communication with a common air delivery ducting network and are using the evaporative cooler when climatic conditions allow the effective use thereof and operate the more costly and energy consuming refrigeration unit only when the evaporative cooler becomes ineffective. This has proven to be successful as far as the reduction of energy and the lowering of operating costs are concerned. However, the search continues for further improvements.

To the best of my knowledge, nothing has been devised, or suggested to supplement the operation of evaporative coolers to enable them to satisfactorily cool air in spite of climatic conditions with the object being to completely replace the more expensive refrigeration units or at least substantially reduce the use time in the above described combination air conditioning system.

SUMMARY OF THE INVENTION

In accordance with the present invention, a new and improved air cooling apparatus is disclosed for cooling air in accordance with two principles, namely, the evaporation principle and the heat exchange principle to overcome, or at least substantially reduce, the inherent limitations of cooling air solely by the evaporation principle.

The apparatus of the present invention is configured similar to that of an evaporative cooler in that it includes a cabinet having an air moving device mounted therein for drawing ambient air into the cabinet through wettable pads mounted in the sides thereof. As the air moves through the wet pads, it is cooled by evaporation and the air moving device delivers that air to a point of use through an air outlet opening formed in the cabinet. In addition to this, the apparatus is further provided with a chilled water exchange means for lowering the temperature of the incoming ambient air prior to its being evaporatively cooled in the above described manner. Water which is chilled by the evaporation principles as it passes downwardly through the wet pads of the cooler is contained and collected in the cooler's sump. This chilled water is recirculatingly pumped from the cooler's sump through the heat exchanger units and then delivered to the tops of the wettable cooler pads. In passing through the heat exchanger units, the chilled water will absorb some of the heat from the incoming air and the water is then rechilled as it passes downwardly through the cooler pads.

In the preferred embodiment, a separator partition is provided which divides the interior of the cooler's cabinet into an upper compartment and a lower compartment and also divides the wettable cooler pads into upper and lower segments or portions. Air exiting the heat exchanger units and passing through the cooler pads will therefore be divided. The air passing through the upper segments of the cooler pads will be cooled by evaporation and will enter into the upper compartment of the cooler's cabinet and is exhausted therefrom by a suitable auxiliary blower mechanism either to ambient or to a secondary point of use. The air passing through the lower segments of the cooler pads will also be cooled by evaporation and will enter into the lower compartment of the cooler's cabinet and is delivered by the cooler's main air handler mechanism to the principle point of use.

By providing the above described divider partition which splits the air flow, the relatively warm water being delivered to the tops of the cooler pads from the heat exchanger units will be chilled as it passes down through the upper segments of the divided cooler pads and thus will be in a chilled state when it reaches the lower segments of the cooler pads. In this manner, the water used in evaporatively cooling the air which is delivered to the principle point of use will be chilled.

Accordingly, it is an object of the present invention to provide a new and improved air cooling apparatus.

Another object of the present invention is to provide a new and improved air cooling apparatus having improved air cooling capabilities as compared to evaporative coolers and being less expensive to operate as compared to refrigeration units.

Another object of the present invention is to provide a new and improved air cooling apparatus which utilizes two separate and distinctly different cooling techniques for inexpensively and efficiently cooling air.

Another object of the present invention is to provide a new and improved air cooling apparatus of the above described character wherein the air to be cooled is reduced in temperature in accordance with the heat exchange principle prior to its being cooled in accordance with the evaporation principle to minimize the adverse affects that high humidity has on the evaporative cooling of air.

Another object of the present invention is to provide a new and improved air cooling apparatus of the above described type wherein the cooling of the air by the heat exchange principle is accomplished by a chilled-water heat exchange mechanism.

Still another object of the present invention is to provide a new and improved air cooling apparatus of the above described character wherein the chilling of water for use in the heat exchanger mechanism is accomplished by evaporation to minimize the costs of such chilling.

The foregoing and other objects of the present invention as well as the invention itself, may be more fully understood from the following description when read in conjunction with the accompanying drawings.

DESCRIPTION OF THE PREFERRED EMBODIMENTS

Figure 1:
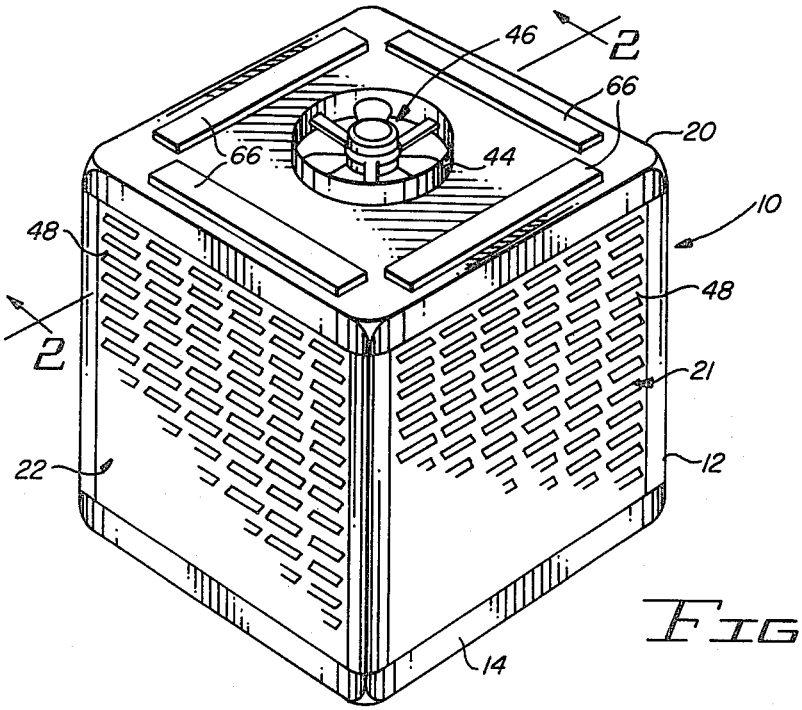
FIG. 1 is a perspective view of the preferred embodiment of the air cooling apparatus of the present invention.

Referring more particularly to the drawings, wherein the air cooling apparatus of the present invention is indicated generally by the reference numeral 10.

Figure 3:
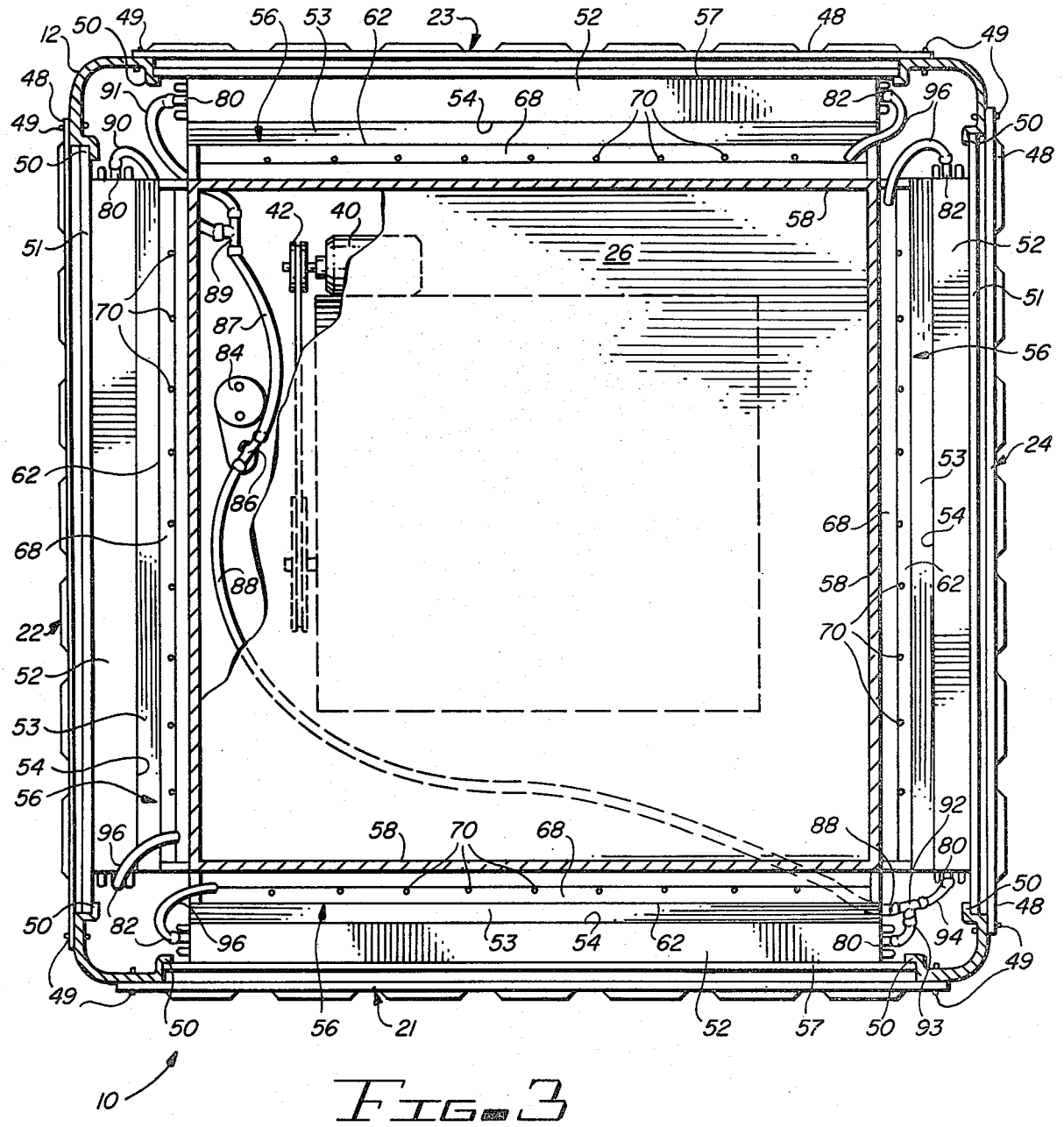
FIG. 3 is a sectional view taken along the line 3—3 of FIG. 2.

The air cooling apparatus 10 includes a cabinet 12 which is formed in accordance with basic techniques well known in the evaporative cooler arts, with the cabinet being modified so that it is suitable for accomplishing the stated objectives of the invention. Accordingly, and as will hereinafter be described in detail the cabinet 12 includes a floor pan 14 having an air outlet duct 16, a roof 20, and as seen in FIG. 3, is provided with four air inlet openings 21, 22, 23 and 24 which are formed in different sidewalls of the cabinet. The cabinet 12 is provided with a horizontally disposed divider partition 26 which separates the cabinet into a main air treatment compartment 28 and a water chilling/auxiliary air treatment compartment 30.

The main air treatment compartment 28 has a suitable air handling device 32 mounted therein which in the illustrated embodiment is in the form of a centrifugal blower. The air handling device 32 is of the wall known type extensively used in the evaporative cooler art and therefore its structural details and operation will only be briefly described herein. The air handler device 32 includes a scroll-shaped housing 34 having an axial air inlet 35 (one shown) in which each of its opposite sidewalls and a centrifugal outlet 36 which is suitably connected to the outlet duct 16. A blower wheel 37 having an axle shaft 38 is coaxially located between the air inlets 35 and is rotatably journalled for rotation therein. An electric motor 40 is mounted on the housing 34 with its output shaft being coupled to the axle shaft 38 of the blower wheel 37 by a belt and pulley mechanism 42 so that the motor 40 rotatably drives the blower wheel 37. In operation, rotation of the blower wheel 37 will move air out of the centrifugal outlet 36 and in doing so will create a negative static pressure which is felt in the centrifugal housing 34 and the main air treatment compartment 28 of the cabinet. The negative static pressure results in ambient air being drawn through the air inlets 21, 22, 23 and 24 into the main air treatment compartment 28 of the cabinet 12 and from there through the axial inlets 35 into the housing 32 and from there it is delivered through the centrifugal outlet 36 and the duct 16 to a principle point of use.

The roof 20 of the cooler cabinet 12 is formed with an auxiliary air outlet duct 44 which opens inwardly so as to be in communication with the water chilling/auxiliary air treatment compartment 30 of the cooler. An auxiliary air handler means 46, which is illustrated in the form of a motor driven fan, is mounted such as by suitable struts, or brackets 47, so as to be axially positioned in the auxiliary air outlet duct 44. The auxiliary air handler means 46 is used to exhaust air from the water chilling/auxiliary air treatment compartment 30 and thereby drawing ambient air into the compartment through the air inlet openings 21, 22, 23 and 24. The auxiliary air outlet duct 44 may simply open to ambient or may be coupled to suitable ducts (not shown) to deliver the auxiliary air to a secondary point of use.

Each of the air inlet openings 21, 22, 23 and 24 of the cabinet 12 have identical mechanisms mounted adjacent thereto for cooling the incoming ambient air as it passes through those openings into the compartments 28 and 30. Since the mechanisms mounted adjacent each of the air inlet openings 21, 22, 23 and 24 are identical, the following detailed description of the mechanisms associated with the inlet 22 will be understood to also apply to the mechanisms associated with the other air inlet openings 21, 23 and 24.

Figure 2:
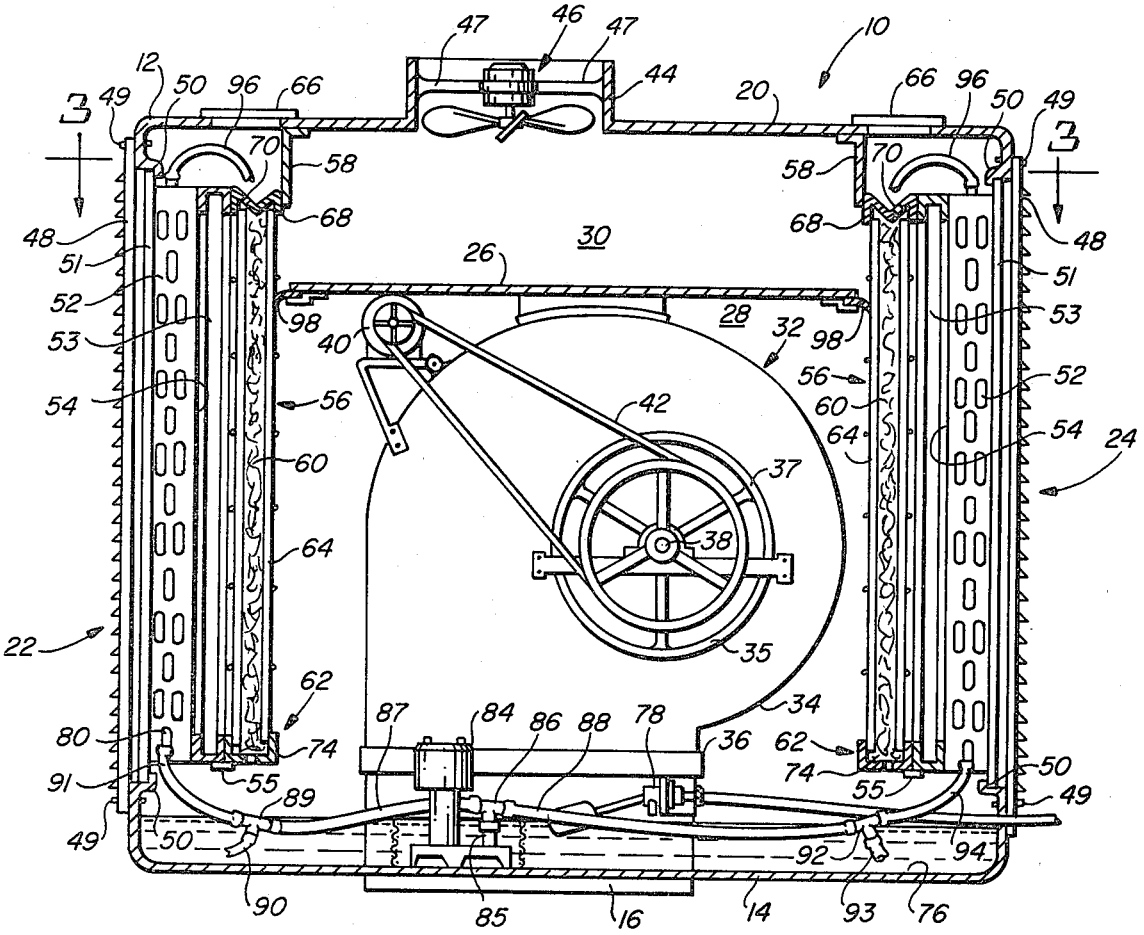
FIG. 2 is an enlarged sectional view taken along the line 2—2 of FIG. 1.

As seen in FIG. 2, a suitable louver plate 48 is demountably carried on the exterior of the cabinet 12, such as by means of the illustrated snap fasteners 49, so as to overlay the air inlet opening 22. The air inlet opening 22 is defined by an endless recessed flange 50 to which a flange 51 mounted so as to surround the air inlet face of a heat exchanger unit 52 is suitably attached. The heat exchanger unit 52 is mounted so that ambient air entering through the inlet opening 22 will pass through the heat exchanger unit 52 for lowering the temperature of the air as will hereinafter be described. An endless channel 53 is mounted, such as by welding, on the heat exchanger unit 52 so as to surround the air outlet face 54 thereof. An elongated ledge 55 is carried on the bottom leg of the endless channel 53.

This elongated ledge 55 is used to supportingly carry a wettable fibrous pad 56 with the elongated ledge 55 and the endless channel 53, in conjunction with a partial wall 58 depending from the roof of the cabinet 12, defining an open framework which supportingly locates the wettable pad 56 so that air emerging from the heat exchanger unit 52 will pass through the wettable pad. The wettable pad 56 is of the type commonly used in evaporative coolers and thus includes a loosely packed fibrous material 60, usually excelsior, the edges of which are supported by a sheet metal frame 62 and wire mesh grills 64 are used to support the opposite planar surfaces of the fibrous material.

As is known in the art, the wettable pad 56 must be periodically removed for replacement of the fibrous material 60 which during use becomes contaminated with dirt and other foreign matter and will become impregnated with scale which forms as a result of the evaporation process which leaves mineral deposits behind. For this reason, the framework which supports the wettable pad 56 is open at the top and an elongated access opening having a removable cap 66 mounted therein, is formed through the roof 20 of the cabinet 12 so as to be in vertical alignment with the pad 56.

The top leg 68 of the sheet metal frame 62 which supports the fibrous material 60 of the pad 56 is configured in the form of a V-shaped in cross section trough having spaced slits 70 formed therein. This trough leg 68 receives water as will hereinafter be described, and distributes the water evenly across the top of the fibrous material 60. The water trickles down through the pad 56 under the influence of gravity and such wetting of the pad will evaporatively cool the air passing therethrough. The unevaporated water passes through suitable apertures formed in the bottom leg 74 of the sheet metal frame and falls into a sump 76 defined by the floor pan 14 of the cabinet 12.

Water from an external source (not shown) is supplied to the sump 76 through a float controlled shutoff valve 78 of the well known type which is used to initially supply water to the sump and also to supply make-up water thereto for replacing that lost by evaporation.

The heat exchanger units 52 are each mounted in a different one of the air inlet openings 21, 22, 23 and 24, as hereinbefore mentioned, and those heat exchangers may be of any suitable type and are illustrated as being of the fin-tube type which are commonly used in various applications such as the radiators of automotive vehicles, coils in refrigeration units and the like. Each of the heat exchanger units 52 is provided with a water inlet 80 and a water outlet 82.

A suitable pump 84 is mounted in the sump 76 of the cooler and is provided with an outlet boss 85. A tee 86 is mounted on the water outlet boss 85 of the pump 84 with first and second water delivery conduits or pipelines 87 and 88 being connected to the opposed branches of the tee 86. The first water delivery conduit 87 extends from the pump 84 to another tee 89 which divides the pumped water between a pair of distribution conduits or pipelines 90 and 91 which are connected to the water inlets 80 of two of the heat exchangers 52. The second water delivery conduit 88 similarly extends from the pump 84 to a tee 92 which divides the pumped water between another pair of distribution conduits, or pipelines 93 and 94 which are connected to the water inlets of the other two heat exchangers 52.

As is known, the water contained within the sump 76 of the evaporative cooler will be chilled to approximately wet bulb temperature due to the evaporation process which takes place when the water passes downwardly through the cooler pads 56. This chilled water is supplied by the pump 84, and the above described plumbing network, to the inlets 80 of the heat exchangers 52. Thus, chilled water will flow through the heat exchangers 52 and will absorb heat from the ambient air which is moved through the heat exchangers on its way to the evaporative cooler pads 56.

When the chilled water moves through the heat exchangers 52, it is directed by suitable conduits or pipelines 96 which are connected to the water outlets 82 of the heat exchangers, to the V-shaped troughs 68 at the tops of the evaporative cooler pads 56 and will thus wet the pads on its way back to the sump 76.

It will now be appreciated that by subjecting the ambient air, which is drawn into the chambers 28 and 30, to two separate air cooling steps, that air will be cooled to lower temperatures than can be achieved by either one of the steps separately.

The water being supplied to the tops of the cooler pads 56 will have been warmed by its passage through the heat exchanger 52, and thus may be at a temperature which is somewhat higher than is desirable for use in the evaporative cooling of the air which takes place in the evaporative cooler pads 56. To overcome this, the cooler cabinet 12 has the horizontally disposed partition 26 which divides the cabinet into the main air treatment compartment 28 and the water chilling/auxiliary air treatment compartment 30 as hereinbefore described. As seen in FIG. 2, the partition 26 is provided with an endless edge seal 98 which is in engagement with the cooler pads 56 at locations to separate the pads into relatively small top portions and larger bottom portions. With this configuration, the air moving through the top portions of the pads 56 into the water chilling/auxiliary air treatment compartment 30 will, of course, be cooled by evaporation and the water passing downwardly through the top portions of the pads will be chilled to a desirable temperature for use in evaporatively cooling the air which is drawn through the lower portions of the pads into the main air treatment compartment 28.

While the principles of the invention have now been made clear in illustrated embodiments, there will be immediately obvious to those skilled in the art, many modifications of structure arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An air cooling apparatus comprising in combination:

a. an evaporative cooler including,

I. a cabinet having at least one air inlet opening,

II. an air handler in said cabinet for drawing ambient air through said air inlet opening into said cabinet, III. a wettable fibrous pad mounted in said air inlet opening, IV. a sump for containing a water supply;

b. a heat exchanger mounted in said air inlet opening of said cabinet in front of said wettable fibrous pad in overlaying relationship so that the ambient air will pass through said heat exchanger prior to passing through said wettable fibrous pad; and c. pump means in said evaporative cooler for recirculatingly supplying water from said sump through said heat exchanger and from said heat exchanger through said wettable fibrous pad.

2. An air cooling apparatus as claimed in claim 1 wherein said pump means comprises:

a. a pump in said sump of said evaporative cooler;

b. a first pipeline connected between the outlet of said pump and the water inlet of said heat exchanger; and c. a second pipeline extending from the water outlet of said heat exchanger to the top of said wettable fibrous pad.

3. An air cooling apparatus as claimed in claim 1 wherein said evaporative cooler further comprises means in said cabinet for evaporatively chilling the water after it passes through said heat exchanger.

4. An air cooling apparatus as claimed in claim 3 wherein said means includes a partition for dividing the interior of said cabinet into a main air treatment compartment in the lower end thereof and a water chilling-/auxiliary air treatment compartment in the upper end thereof.

5. An air cooling apparatus as claimed in claim 3 wherein said means comprises:

a. a partition extending horizontally within said cabinet to provide a main air treatment compartment below said partition and a water chilling/auxiliary air treatment compartment above said partition;

b. said partition being in engagement with said wettable fibrous pad to provide a water chilling portion at the upper end thereof;

c. said air handler being disposed in the main air treatment compartment of said cabinet for drawing air thereinto through the lower portion of said wettable fibrous pad; and d. a second air handler in the water chilling/auxiliary air treatment compartment of said cabinet for drawing air thereinto through the water chilling upper portion of said wettable fibrous pad.

6. An air cooling apparatus as claimed in claim 5 wherein said air handler includes means for delivering cooled air from said main air treatment compartment of said cabinet to a point of use.

7. An air cooling apparatus as claimed in claim 5 wherein said second air handler includes means for exhausting cooled air from said water chilling/auxiliary air treatment compartment of said cabinet.

8. An air cooling apparatus as claimed in claim 1 and further comprising:

a. a partition within said cabinet for dividing the interior thereof into a main air treatment compartment in the lower end of said cabinet and a water chilling/auxiliary air treatment compartment in the upper end of said cabinet, said partition being in engagement with said wettable fibrous pad to provide a water chilling portion at the upper end thereof;

b. said air handler being in said main air treatment compartment of said cabinet for drawing cooled air thereinto through the lower portion of said wettable fibrous pad, said air handler having means for delivering the cooled air to a point of use; and c. a second air handler mounted in said water chilling/auxiliary air treatment compartment of said cabinet for drawing cooled air thereinto through the water chilling portion of said wettable fibrous pad, said second air handler having means for exhausting cooled air from said water chilling/auxiliary air treatment compartment of said cabinet.

* * * * *